United States Patent [19]

Streich

[11] Patent Number: 4,773,478

[45] Date of Patent: Sep. 27, 1988

[54] HYDRAULIC SETTING TOOL

[75] Inventor: Steven G. Streich, Duncan, Okla.

[73] Assignee: Halliburton Company, Duncan, Okla.

[21] Appl. No.: 54,644

[22] Filed: May 27, 1987

[51] Int. Cl.[4] ..... E21B 23/06

[52] U.S. Cl. ..... 166/120; 166/125; 166/181

[58] Field of Search ..... 166/120, 123, 125, 128, 166/133, 143, 181, 182, 188, 152, 196, 212, 317, 334

[56] References Cited

U.S. PATENT DOCUMENTS

| | | | |
|---|---|---|---|
| 2,467,801 | 4/1949 | Baker | 166/120 |
| 2,624,412 | 1/1953 | Ragan | 166/120 |
| 2,630,865 | 3/1953 | Baker | 166/120 |
| 2,687,775 | 8/1954 | Baker | 166/125 X |
| 4,096,913 | 6/1978 | Kenneday et al. | 166/120 X |
| 4,185,689 | 1/1980 | Harris | 166/133 |
| 4,373,584 | 2/1983 | Silberman et al. | 166/117.7 |
| 4,436,149 | 3/1984 | Edwards | 166/120 |
| 4,438,811 | 3/1984 | Patel | 166/123 |
| 4,441,552 | 4/1984 | Hamman | 166/133 |
| 4,493,374 | 1/1985 | Magee, Jr. | 166/120 X |
| 4,516,634 | 5/1985 | Pitts | 166/120 |
| 4,564,068 | 1/1986 | Baugh | 166/123 |
| 4,688,634 | 8/1987 | Lustig et al. | 166/123 X |

*Primary Examiner*—Stephen J. Novosad
*Assistant Examiner*—William P. Neuder
*Attorney, Agent, or Firm*—James R. Duzan

[57] ABSTRACT

The hydraulic setting tool of the present invention comprises an adapter, housing, piston, piston sleeve and shear sleeve rod.

12 Claims, 1 Drawing Sheet

HYDRAULIC SETTING TOOL

BACKGROUND OF THE INVENTION

This invention relates to a hydraulic setting tool for packers and bridge plugs. More specifically, this invention relates to a hydraluic setting tool for a bridge plug for use in geothermal steam producing wells.

Hydraulic setting tools for packers and bridge plugs are well known in the art. Some examples of prior art hydraulic setting tools for packers and bridge plugs are shown in U.S. Pat. Nos. 4,436,149, 4,441,552 and 4,516,634. However, such prior art hydraulic packer and bridge plug setting tools are either complex in construction and/or operation or require the use of balls or plugs to be pumped through the tubing string for the actuation of the setting tool in response to hydraulic fluid pressure in either the tubing string or annulus between the tubing string and well casing in which the packer or bridge plug is being set.

In steam producing geothermal wells or in highly deviated wells it is desirable to have a hydraulic setting tool which is simple in construction and actuation, does not allow steam from the well or well fluid to flow into the tubing string while the packer or bridge plug is being run into the well, does not require either rotational or longitudinal movement of the tubing work string or drill pipe to actuate the setting tool, and does not use balls or plugs to actuate the setting tool.

STATEMENT OF THE INVENTION

The present invention is directed to a hydraulic setting tool for packers and bridge plugs which is simple in construction and actuation, does not allow the flow of fluids into the tubing string upon which the setting tool and packer or bridge plug is being run into the well, does not require either rotational or longitudinal movement of the testing work string or drill pipe to actuate the setting tool, does not use balls or plugs to actuate the setting tool, and allows circulation of the well fluid after the packer or bridge plug is set. The hydraulic setting tool of the present invention comprises an adapter, housing, piston, piston sleeve and shear sleeve rod.

DETAILED DESCRIPTION OF THE DRAWINGS

Figure 1:
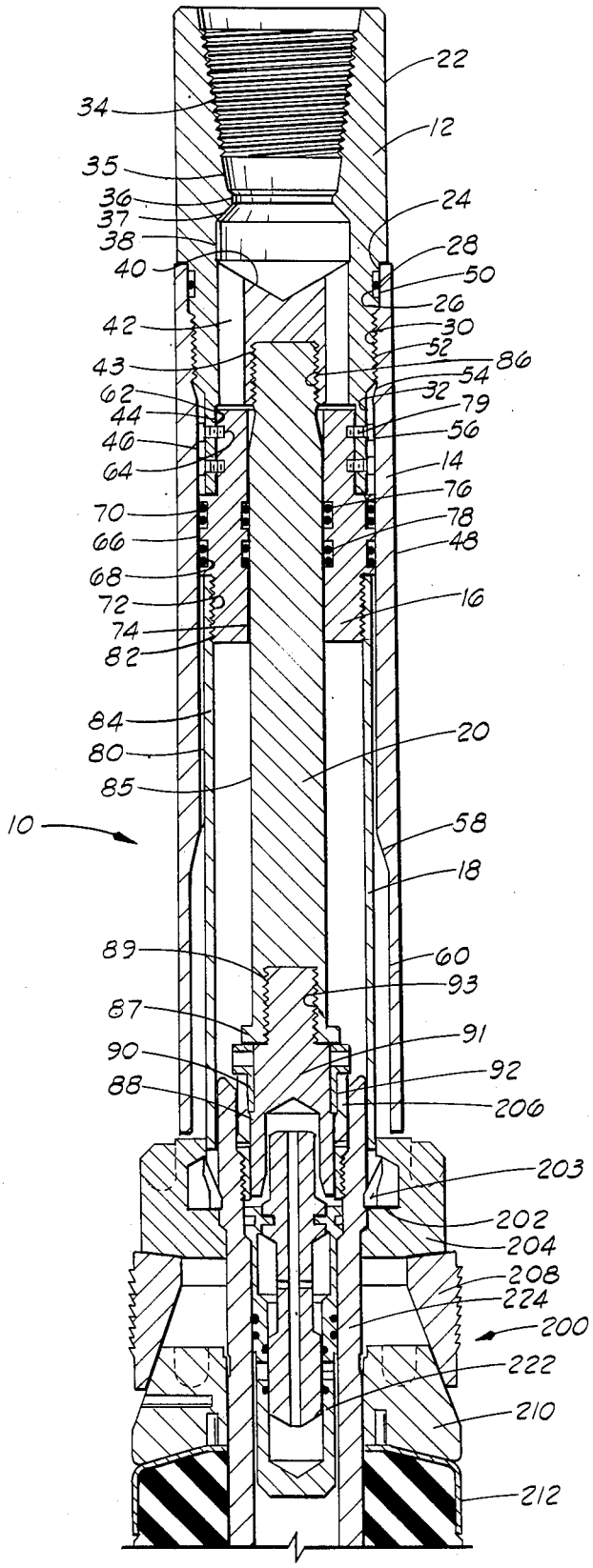
FIG. 1 is a cross-sectional view of the hydraulic setting tool of the present invention connected to the upper portion of a bridge plug.

The hydraulic setting tool 10 of the present invention is shown in FIG. 1 in its preferred embodiment.

The hydraulic setting tool 10 comprises an adapter 12, housing 14, piston 16, piston sleeve 18 and shear sleeve rod 20. Also shown in FIG. 1 is the upper portion of a bridge plug 200 to which the hydraulic setting tool 10 is connected. The bridge plug 200 is similar in construction and operation to the bridge plug described and shown in U.S. Pat. No. 4,185,689. The bridge plug 200 shown in FIG. 1 has a flat annular surface 202 on upper slip support 204 for a portion of the hydraulic setting tool 10 to bear upon during actuation of the setting tool. The bridge plug 200 also includes upper slips 208 and lock ring 203 contained within upper slip support 204.

The adapter 12 of the hydraulic setting tool 10 comprises a cylindrical annular member having, on the exterior thereof first cylindrical surface 22, second cylindrical surface 24 having annular recess 26 therein containing annular elastomeric seal means 28, threaded surface 30 and third cylindrical surface 32 and, on the interior thereof, threaded bore 34, first frusto-conical bore 35, first bore 36, second frusto-conical bore 37, second bore 38, frusto-conical surface 40, a plurality of axial passageways 42, threaded blind bore 43, and second bore 44. The adapter 12 further includes a plurality of apertures 46 extending from third cylindrical surface 32 to second bore 44.

The housing 14 of the hydraulic setting tool 10 comprises an elongated annular cylindrical member having, on the exterior thereof, cylindrical surface 48 and, on the interior thereof, first cylindrical surface 50 which sealingly engages annular elastomeric seal means 28 of adapter 12, threaded bore 52 which releasably engages threaded surface 30 of adapter 12, first frusto-conical bore 54, second bore 56, second frusto-conical bore 58 and third bore 60.

The piston 16 of the hydraulic setting tool 10 comprises an annular cylindrical member having, on the exterior thereof, first cylindrical surface 62 having annular recess 64 therein, second cylindrical surface 66 having a plurality of recesses 68 therein containing annular elastomeric seal means 70 which slidingly, sealingly engage second bore 56 of housing 14 and threaded surface 72 and, on the interior thereof, bore 74 having a plurality of annular recesses 76 therein containing annular elastomeric seal means 78. The piston 16 further includes a plurality of shear pins 79 having a portion thereof engaging apertures 46 of adapter 12 and a portion thereof extending into annular recess 74 of piston 16.

The piston sleeve 18 of the hydraulic setting tool 10 comprises an elongated annular cylindrical member having, on the exterior thereof, cylindrical surface 80 and, on the interior thereof, threaded bore 82 which releasably engages threaded surface 72 of piston 16 and bore 84.

The shear sleeve rod 20 of the hydraulic setting tool 10 comprises an elongated cylindrical member having threaded upper end 86, cylindrical surface 85 which slidingly, sealingly engages annular elastomeric seal means 78 of piston 16, annular flange 87 on the bottom end thereof, and blind threaded bore 89 therein. The shear sleeve rod 20 further includes shear rod adapter end 91 having threaded end 93 which releasably engages blind threaded bore 89 of rod 20 and annular flange 88 thereon and shear sleeve adapter 90 which has one end thereof abutting annular flange 85 of rod 20 while the other end thereof abuts annular flange 88 of shear rod adapter end 91 and threaded exterior surface 92 which releasably engages shear sleeve 206 of bridge plug 200.

Figure 1A:
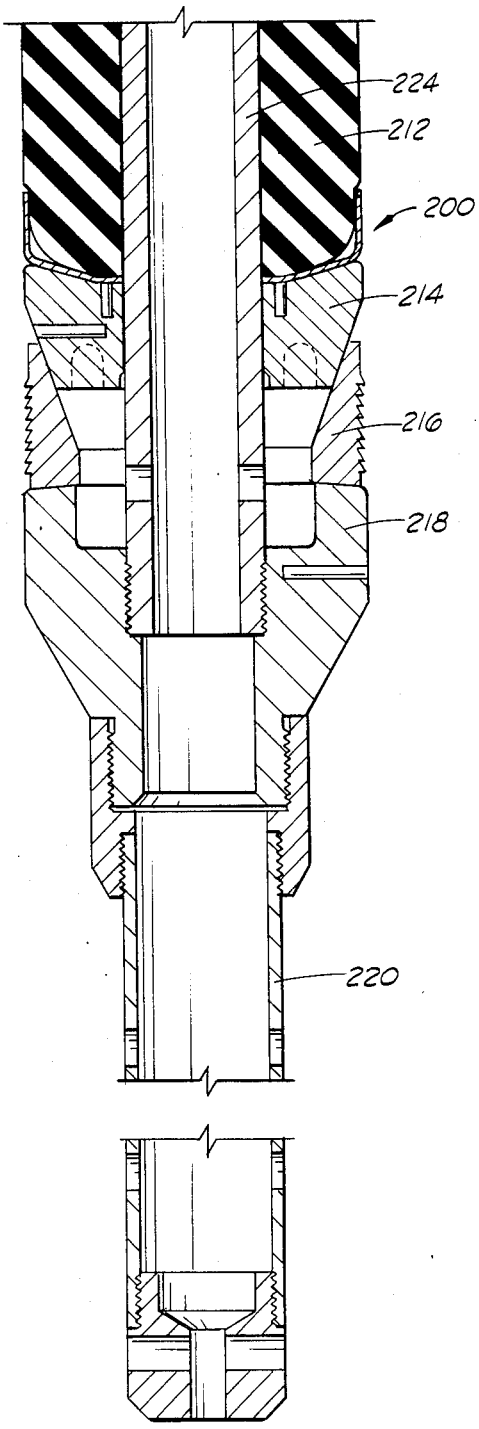
FIG. 1A is a cross-sectional view of the remaining portion of the bridge plug shown in FIG. 1.

Referring to FIG. 1A, the remaining portion of the bridge plug 200 is shown. The bridge plug 200 includes upper slip wedge 210, packer element 212 lower slip wedge 214, slips 216, lower slip support 218, catcher assembly 220, push out plug assembly 222, and mandrel 224.

OPERATION OF THE INVENTION

Referring again to FIG. 1, the operation of the hydraulic setting tool 10 of the present invention will be set forth.

The hydraulic setting tool 10 is connected to a work string of tubing or drill pipe by adapter 12 threadedly engaging one end thereof. The bridge plug 200 or packer is retained upon the hydraulic setting tool 10 by shear sleeve rod 20 having shear sleeve adapter 90 threadedly engaging shear ring 206 of bridge plug 200.

After the hydraulic setting tool 10 having bridge plug 200 connected thereto is assembled on the work string of tubing or drill pipe, the hydraulic setting tool 10 and bridge plug 200 are run into the well to the desired location at which the bridge plug is to be set.

To actuate the hydraulic setting tool 10 fluid pressure in the work string of tubing or drill pipe is increased until the fluid pressure acting on the upper end of piston 16 is great enough to cause the shear pins 79 to shear thereby allowing piston 16 having piston sleeve 18 connected thereto to move downwardly causing the lower end of the piston sleeve 18 to spread lock ring 203 outwardly so that sleeve 18 may pass therethrough to bear on flat annular surface 202 of upper slip support 204 of bridge plug 200. The piston 16 and piston sleeve 18 continue to move downwardly causing upper slips 208 to be cammed into engagement with the casing (not shown) in the well bore.

When the upper slips 208 engage the casing in the well bore, further downward movement of the upper slips 208 is prevented. After the slips 208 engage the casing in the well bore, the relative movement between the piston 16 and adapter 12 having housing 14 and shear rod 20 secured thereto occurs because the increased fluid pressure causes the force acting upwardly on adapter 12, housing 14 and shear sleeve rod 20 to be greater than the force acting downwardly on shear sleeve rod 20. At this point, the downward movement of piston 16 and piston sleeve 18 generally ceases and the shear sleeve rod 20 moves upwardly relative to the piston 16 and piston sleeve 18 until the force acting on shear sleeve 206 of bridge plug via shear sleeve rod 20 causes the shear sleeve 206 to shear thereby releasing the shear sleeve rod 20 from the shear sleeve 206 and bridge plug 200. During the relative upward movement of the shear sleeve rod 20, since the shear sleeve 206 of the bridge plug 200 is attached to the mandrel 224 of the bridge plug which, in turn, is attached to lower slip suport 218 of the bridge plug 200, the lower slips 216 are brought into engagement with the casing in the well which thereby prevents any further upward movement of the shear ring rod 20 until the shear ring 206 shears thereby releasing rod 20. At this point, the bridge plug 200 is set in the casing in the well and the hydraulic setting tool is released therefrom when sleeve 206 shears.

At this time, sand or gelled fluid can then be placed on top of plug or the well can be circulated with fluid from the bridge plug up by pumping fluid through the tubing work string or drill pipe through passageways 42 in adapter 12, through the annulus between the housing 14 and shear sleeve rod 20, past piston 16 which is abutting annular flange 87 on shear sleeve rod 20 and out the annulus formed between third bore 60 of housing 14 and cylindrical surface 80 of piston 16 over the top of bridge plug 200 into the casing in the well bore.

Thus, it can be seen from the foregoing that the construction of the hydraulic setting tool 10 is simple, that the operation of the hydraulic setting tool 10 is simple, that fluid flow through the hydraulic setting tool 10 is prevented by the piston 16 and shear sleeve rod 20, that no balls or plugs are required to be pumped through the tubing work string or drill pipe to be able to actuate the hydraulic setting tool 10, and that no rotation or longitudinal movement of the tubing work string or drill pipe is required to actuate the hydraulic setting tool 10, and that the fluid in the annulus between the tubing work string or drill pipe and the casing in the well bore may be circulated out if desired.

Having thus described by invention, I claim:

1. A hydraulic setting tool attached to one end of a conduit string conveyed into a well, said hydraulic setting tool having a portion thereof attached to a packer conveyed into said well by said conduit string, said hydraulic setting tool comprising:

an adapter having a portion thereof secured to said conduit string;

a housing having a portion thereof secured to said adapter;

a piston having a portion thereof slidably sealingly engaging a portion of said housing;

a releasable retaining means retaining said piston in a first position within said housing, said releasable retaining means having a portion thereof engaging said housing and another portion thereof engaging said piston;

a piston sleeve having a portion thereof secured to said piston and slidable within said housing; and a shear sleeve rod having one end thereof attached to a portion of said adapter and the other end thereof attached to a portion of said packer, said shear sleeve rod slidably, sealingly engaging a portion of said piston.

2. The hydraulic setting tool of claim 1 wherein said shear sleeve rod comprises:

an elongated cylindrical rod having an annular flange thereon; and a shear sleeve adapter retained in one direction on the elongated cylindrical rod by the annular flange thereon.

3. The hydraulic setting tool of claim 1 wherein said releasable retaining means further comprises:

at least one shear pin extending between said adapter and said piston for releasably retaining said piston in a first position in said hydraulic setting tool.

4. The hydraulic setting tool of claim 1 wherein said piston includes:

exterior annular elastomeric seals on the exterior of said piston for slidably sealingly engaging a portion of said housing; and interior annular elastomeric seals on the interior of said piston for slidably sealingly engaging a portion of said shear sleeve rod.

5. The hydraulic setting tool of claim 1 wherein said adapter further includes:

at least one axial passageway extending therethrough to allow fluid flow from said conduit string to said piston.

6. The hydraulic setting tool of claim 1 further comprising:

an annular elastomeric seal sealing between said adapter and said housing.

7. A hydraulic setting tool attached to one end of a conduit string conveyed into a well, said hydraulic setting tool having a portion thereof attached to a bridge plug conveyed into said well by said conduit string, said hydraulic setting tool comprising:

an adapter having a portion thereof secured to said conduit string;

a housing having a portion thereof securd to said adapter;

a piston having a portion thereof slidably sealingly engaging a portion of said housing;

a releasable retaining means retaining said piston in a first position within said housing, said releasable retaining means having a portion thereof engaging said housing and another portion thereof engaging said piston;

a piston sleeve having a portion thereof secured to said piston and slidable within said housing; and a shear sleeve rod having one end thereof attached to a portion of said adapter and the other end thereof attached to a portion of said bridge plug, said shear sleeve rod slidably, sealingly engaging a portion of said piston.

8. The hydraulic setting tool of claim 7 wherein said shear sleeve rod comprises:

an elongated cylindrical rod having an annular flange thereon; and a shear sleeve adapter retained in one direction on the elongated cylindrical rod by the annular flange thereon.

9. The hydraulic setting tool of claim 7 wherein said releasable retaining means further comprises:

at least one shear pin extending between said adapter and said piston for releasably retaining said piston in a first position in said hydraulic setting tool.

10. The hydraulic setting tool of claim 7 wherein said piston includes:

exterior annular elastomeric seals on the exterior of said piston for slidably sealingly engaging a portion of said housing; and interior annular elastomeric seals on the interior of said piston for slidably sealingly engaging a portion of said shear sleeve rod.

11. The hydraulic setting tool of claim 7 wherein said adapter further includes:

at least one axial passageway extending therethrough to allow fluid flow from said conduit string to said piston.

12. The hydraulic setting tool of claim 7 further comprising:

an annular elastomeric seal sealing between said adapter and said housing.

* * * * *